US009341440B2

(12) United States Patent
Moore

(10) Patent No.: US 9,341,440 B2
(45) **Date of Patent: *May 17, 2016**

(54) FRONT-GRIP LIGHTING DEVICE

(71) Applicant: Larry E. Moore, Cottonwood, AZ (US)

(72) Inventor: Larry E. Moore, Cottonwood, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/793,016

(22) Filed: Jul. 7, 2015

(65) Prior Publication Data

US 2015/0316348 A1 Nov. 5, 2015

Related U.S. Application Data

(63) Continuation of application No. 14/182,140, filed on Feb. 17, 2014, now Pat. No. 9,182,194.

(51) Int. Cl.

| | |
|---|---|
| ***F41G 1/35*** | (2006.01) |
| ***F41C 23/16*** | (2006.01) |
| ***F41G 11/00*** | (2006.01) |
| ***F41C 23/22*** | (2006.01) |

(52) U.S. Cl.

CPC ..... *F41C 23/16* (2013.01); *F41C 23/22* (2013.01); *F41G 1/35* (2013.01); *F41G 11/003* (2013.01)

(58) Field of Classification Search

CPC ..... F41G 1/35; F41G 11/003; F41C 27/00; F41C 23/16

USPC ..... 42/72, 71.01, 84, 85, 90, 114, 115, 117, 42/146

See application file for complete search history.

(56) References Cited

U.S. PATENT DOCUMENTS 5,208,826 A * 5/1993 Kelly ..... F41G 1/35 248/176.1
6,219,952 B1 * 4/2001 Mossberg ..... F41A 17/063 42/70.01
6,282,829 B1 * 9/2001 Mossberg ..... F41A 17/063 42/70.04
7,827,726 B2 * 11/2010 Stokes ..... F41C 23/16 362/111
8,001,715 B2 * 8/2011 Stokes ..... F41C 23/16 362/111
8,141,288 B2 * 3/2012 Dodd ..... F41C 23/22 42/124
8,146,282 B2 * 4/2012 Cabahug ..... F41C 23/22 42/71.01
8,397,418 B2 * 3/2013 Cabahug ..... F41C 23/22 42/71.01
8,443,539 B2 * 5/2013 Cabahug ..... F41C 23/22 42/71.01
8,516,731 B2 * 8/2013 Cabahug ..... F41C 23/22 42/124
8,584,587 B2 * 11/2013 Uhr ..... F41G 3/2655 102/444
8,662,694 B1 * 3/2014 Izumi ..... F41G 1/34 362/109
8,734,156 B2 * 5/2014 Uhr ..... F41A 17/44 7/44
8,807,779 B1 * 8/2014 Izumi ..... F41G 1/34 362/109
2005/0130739 A1 * 6/2005 Argentar ..... A63F 13/02 436/36
2007/0039226 A1 * 2/2007 Stokes ..... F41C 23/16 42/146
2011/0074303 A1 * 3/2011 Stokes ..... F41C 23/16 315/250
2012/0144716 A1 * 6/2012 Cabahug ..... F41C 23/22 42/84
2013/0185978 A1 * 7/2013 Dodd ..... F41C 23/22 42/84
2014/0007485 A1 * 1/2014 Castejon ..... F41G 1/35 42/117
2014/0355258 A1 * 12/2014 Izumi ..... F41G 1/34 362/114

* cited by examiner

*Primary Examiner* — Michael David
(74) *Attorney, Agent, or Firm* — Snell & Wilmer LLP

(57) ABSTRACT

A fore grip for a firearm houses a light source and power source. The light source is preferably a laser and the power source is preferably one or more batteries. A first switch is connected to a PCB and can be moved to respective positions that correspond to each of various operating conditions, such as continuously on, continuously off, and on when a second switch is activated.

17 Claims, 3 Drawing Sheets

FRONT-GRIP LIGHTING DEVICE

CROSS REFERENCE TO RELATED APPLICATION

This application is a continuation of and claims priority to U.S. application Ser. No. 14/182,140 entitled "FRONT-GRIP LIGHTING DEVICE", filed on Feb. 17, 2014, the contents of which are incorporated herein in its entirety for all purposes.

FIELD OF THE INVENTION

The present invention is generally directed to a lighting device for a firearm that is positioned in a front grip of the firearm.

BACKGROUND OF THE INVENTION

Vertical fore grips have become popular with firearms, such as rifles and machine pistols. A fore grip provides the operator with a front handle to both support and help aim the firearm. Fore grips usually include an elongated handle that can be gripped by the hand not operating the trigger. Often, the fore grip is removable and attached to the firearm by a bracket that attaches to a rail (such as a picatinny rail) underneath the firearm.

In addition to elongated handles, vertical fore grips have included other variations such as bipods or tripods to support the firearm while firing it.

Often the rail type brackets underneath the firearm are used to support accessories such as lights. However, using a removable fore grip takes away the space that has been used for the accessory lights. Thus, operators often have to choose whether to use the removable fore grips on the bottom facing rails or use accessory lights. To generally solve this problem it has been known to attach lights to vertically-extending fore grips, but the operation of same has been limited.

The disclosures of U.S. Pat. No. 8,127,485 entitled "GUN WITH MOUNTED SIGHTING DEVICE" to Moore et al., U.S. Pat. No. 8,312,665 entitled "SIDE-MOUNTED LIGHTING DEVICE" to Moore et al. and U.S. patent application Ser. No. 13/707,312 entitled "SIGHTING DEVICE REPLICATING SHOTGUN PATTERN SPREAD" to Moore et al. are incorporated herein by reference.

SUMMARY OF THE INVENTION

The present invention relates to a fore grip that can be attached to or integrally formed with a firearm and that includes a light source and a power source housed within the fore grip. The fore grip preferably has a portion generally parallel to the gun barrel and a downward-angled portion, rather than just extending vertically downward from the gun barrel. The light source preferably is a laser and has at least three operating conditions: a first condition wherein the light source is constantly on, a second condition wherein the light source is constantly off, and a third condition wherein the light source is turned on by a second switch. A first switch is moveable between three positions, wherein each of the positions corresponds to one of the three operating conditions. At least one second switch is provided that can be activated in any suitable manner (such as by pressing the second switch). To use the light source, the user moves the first switch to either the first position wherein the light source is constantly on or the third position in which the light source is activated when the second switch is activated. In one embodiment, there are two second switches, one on each side of the fore grip, so that a user can press either of the second switches to activate the light source when the first switch is in the third position.

DETAILED DESCRIPTION OF PREFERRED EMBODIMENTS

Figure 1:
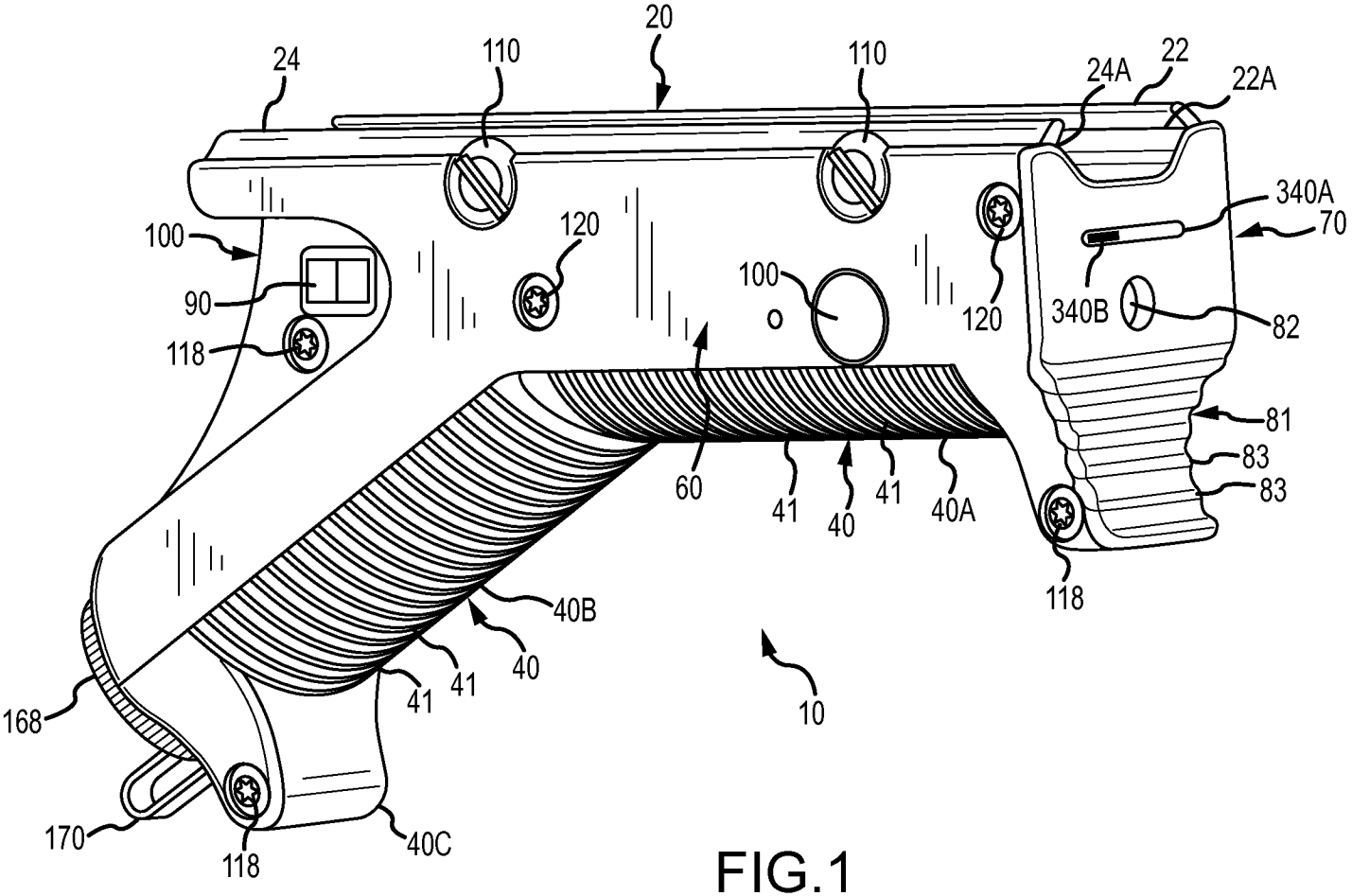
FIG. 1 is a side, perspective view of a fore grip according to aspects of the invention.

Turning now to the drawings, where the purpose is to describe preferred embodiments of the invention and not to limit same, FIG. 1 shows a fore grip 10 according to aspects of the invention. Fore grip 10 has a top portion 20, a bottom portion 40, two side portions 60 and 70, a front portion 80 and rear portion 100. Top portion 20 in this embodiment is designed to fit on the picatinny rail of a firearm, although any suitable method of attachment may be used. Top portion 20 has a first rail 22 and a second rail 24 opposite first rail 22. A groove 22A is at the base of first rail 22 and a groove 24A is at the base of second rail 24. The grooves 22A and 24A oppose one another, and the picatinny rail (not shown) of a firearm is received between the two. Bottom portion 40 as shown has a first portion 40A, which is preferably substantially parallel with the gun barrel when fore grip 10 is mounted on a fire arm, a second portion 40B, which is preferably formed at an angle of about 20° to 45°, and most preferably about 30°, to portion 40A, and a third portion 40C that extends downward and outward at either a vertical or 10°-45° angle away from portion 40B to create support for, and an easy way to properly position on the fore grip, a user's hand.

Fore grip 10 also includes a front grip (or fourth) portion 81 that extends downward from the front of portion 40A and provides an additional gripping surface. Front grip portion 81 may include ridges 83 to facilitate a better grip.

As shown, each of sections 40A and 40B include grooves 41 that assist a user in gripping the fore grip 10 and any suitable structure or surface texturing may be used for this purpose.

Bolts 110 pass through apertures 112 of side 60 and 114 of side 70 and are threaded into nuts 116. In this manner, bolts 110 and nuts 116 tighten grooves 22A and 24A against the picatinny rail of a firearm, although any suitable method or structure for affixing fore grip 10 to a firearm may be used.

To attach casing sides 60 and 70, fasteners 118 and 120 are utilized and pass through apertures in side 60 to be received in bosses 119 (which receive fasteners 118) and bosses 121 (which receive fasteners 120).

Figure 3:
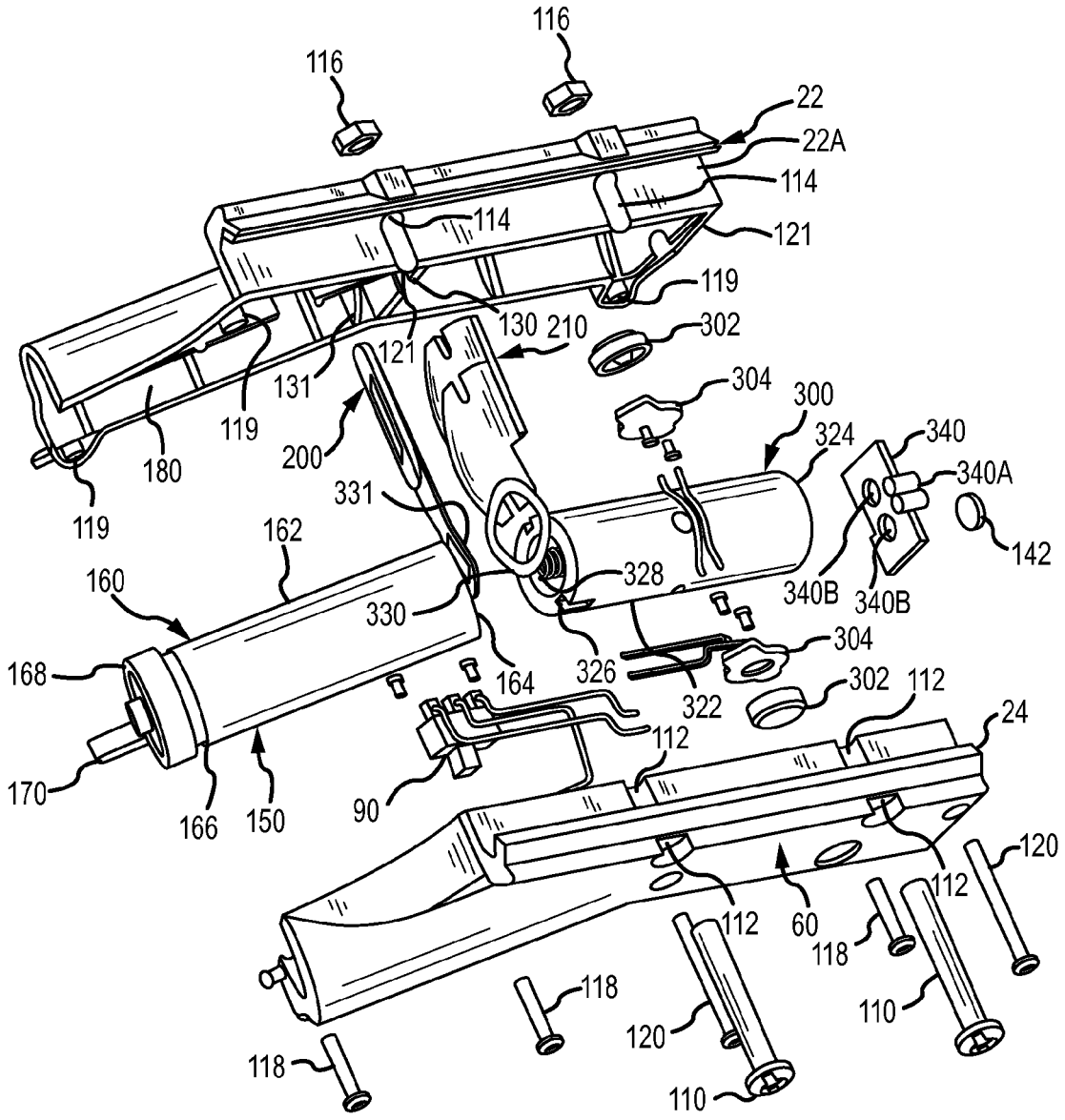
FIG. 3 is an exploded view of the fore grip according to FIG. 1.

A first switch 90 is in communication with the battery module printed circuit board (or PCB) 200 and the laser module PCB 210, each of which are best seen in FIG. 3. In this embodiment the first switch has three positions wherein each position alters the functioning of the battery module PCB 200 and the laser module PCB 210 to enable the laser module 300 to function in one of three ways: (1) continuously off; (2) continuously on; or (3) on only when one of the second switches is pressed. When activated to be on, the laser may pulse to save power, such as by rapidly pulsing off and on at about 500-2000, or about 1000 times per second, at about a 50% duty cycle, although any suitable pulse rate and duty cycle may be used to save power while still providing a laser light beam adequate to sight a target.

One or more second switches 100 can be located at any suitable position on fore grip 10. The purpose of second switch(es) 100 is to communicate with the laser module PCB 210 and activate the laser module 300 when power is available to module 300 because first switch 90 is in its third position. Most preferably switch(es) 100 are momentary switches that are pressed by a user's finger. In the embodiment shown there is a switch 100 on either side, 60 and 70, of fore grip 10. Preferably, switches 100 function so that the laser module 300 is activated if either of switches 100 are pressed. Alternatively, the laser module 300 can be activated only when both second switches 100 are pressed simultaneously (such as simultaneously by the thumb and forefinger of one hand). That manner of operation helps prevent a user from accidentally activating the laser module 300. Further, any of the one or more second switch(es) 100 may be another type of switch, such as a slide switch.

Figure 2:
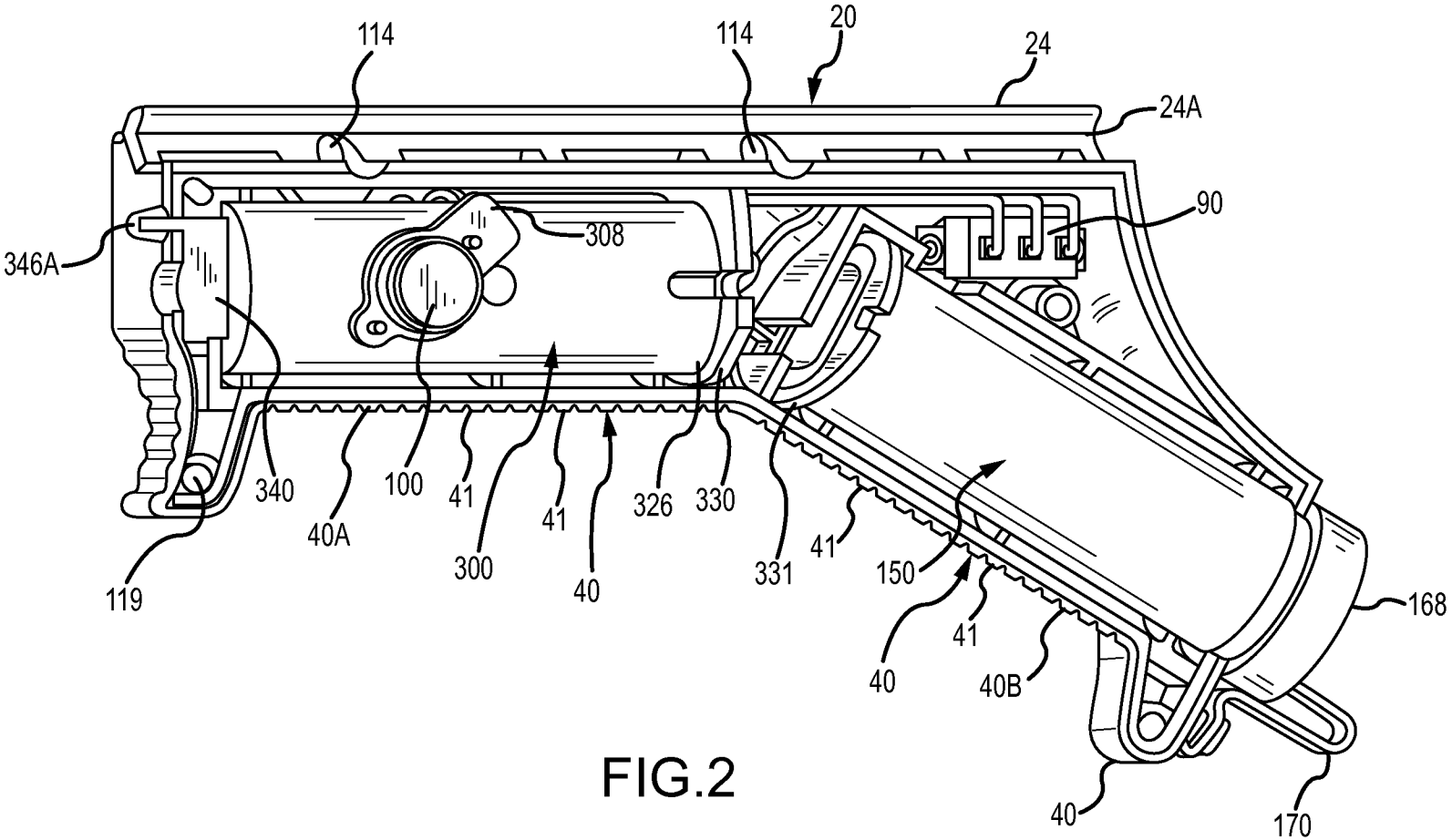
FIG. 2 is a side view of the fore grip according to FIG. 1 with the side of the casing removed to expose the inside.

Second switch(es) 100 are preferably mounted on either side of laser module 300 and include a switch button 302 and a switch board 304, wherein a pad (not shown) is mounted on switch board 304 and is in communication with module 300. As shown best in FIG. 2, wires 308 connect each switch 100 to laser module PCB 210.

Laser module 300 comprises an outer housing 320 that protects an internal laser module (not shown). Outer housing 320 has an annular outer surface 322, a first end 324 having an opening (not shown) through which laser light can pass, and a second end 326 that exposes a spring 328 or other biasing device that is connected to the laser module and (in this embodiment) provides a negative electrical contact. A wave washer 330 is between second end 328 and an internal wall 130 adjacent one of the bosses 121 to pressure fit laser module 300 into place and against laser module PCB 200. A lens (not shown) is at the end of the internal laser module and laser light is projected thorough the lens when the module 300 is activated. The laser light passes through an opening 82 is the front surface 80 of fore grip 10.

As shown, positioned inside of fore grip 10 between first end 324 of laser module 300 and aperture 82 is a laser lens slide 340. Slide 340 is manually moved by a user between a first position wherein the laser light passes through an opening 340B and a second position wherein the laser light passes through another opening 340B. A user moves slide 340 by manually manipulating projection 340A, which extends outward from slot opening 350.

In this embodiment opening 340A had no lens and laser light passing through opening 340A is in a straight beam without interruption. Opening 340B includes a lens 142 that alters the laser light existing the internal laser module, such as to create a pattern of light, such as a cross hair, vertical beam, horizontal beam, circular pattern of light beams, or circular pattern of light beams with a light beam in the center of the circumference of the circular pattern. Alternatively, there need not be a lens slide or the lens slide may have one or more different types of lenses than the ones described herein.

Power module 150 has an outer housing 160 that receives one or more batteries (not shown), which is preferably one 3V lithium photo cell battery, but could be any suitable battery(ies) or power source, and is preferably a 3V power source. Outer housing 160 has an annular outer surface 162, a first end 164 and a second end 166. A cap 168 is removal by attached to second end 166 preferably by being threadingly received, and is attached to the outer-casing of fore grip 10 by strap 170. Cap 168 can be removed to remove and/or add batteries to power module 150. Cap 168 and strap 170 are preferably comprised of any suitable plastic while modules 150 and 300 are preferably comprised of aluminum. Power module 150 fits in cavity 180 and is pressure fit against wave washer 331, which presses against wall 131 and biases module 150 towards power module PCB 210 and provides a negative contact.

Having thus described some embodiments of the invention, other variations and embodiments that do not depart from the spirit of the invention will become apparent to those skilled in the art. The scope of the present invention is thus not limited to any particular embodiment, but is instead set forth in the appended claims and the legal equivalents thereof. Unless expressly stated in the written description or claims, the steps of any method recited in the claims may be performed in any order capable of yielding the desired result.

What is claimed is:

1. A fore grip of a firearm, the fore grip comprising:

(a) a light source wherein the light source is a laser module;

(b) a power source physically separated from and behind the light source, wherein the power source provides power for activating the light source;

(c) a first PCB in electrical communication with a first switch and the power source;

(d) a second PCB in electrical communication with the first PCB and the light source;

(e) a first switch to activate the power source, wherein the first switch has a first position wherein the light source is constantly off, a second position wherein the light source is constantly on, and a third position wherein the light source is on when a second switch is activated; and (f) a first end through which laser light is emitted, and a lens slide juxtaposed the first end, wherein the lens slide includes a plurality of openings and at least one opening includes a lens that modifies the travel of laser light passing through it, the lens slide movable to at least one position at which laser light emitted from the first end passes through one of the plurality of openings.

2. The fore grip of claim 1 wherein the fore grip has a first section that is attached to a gun and the light source is positioned inside of the first section.

3. The fore grip of claim 2 wherein the light source is positioned in a first cavity of the fore grip.

4. The fore grip of claim 1 wherein the fore grip has a second section that extends downward at an angle from the first section and the power source is positioned in the second section.

5. The fore grip of claim 4 wherein the power source is positioned in a second cavity of the fore grip.

6. The fore grip of claim 1 wherein the power source is one or more batteries.

7. The fore grip of claim 1 wherein the second switch is mounted on the light source.

8. The fore grip of claim 1 wherein the second switch is mounted on the laser module.

9. The fore grip of claim 1 that includes a plurality of second switches and when the first switch is in its third position the light source can be activated by activating any of the plurality of second switches.

10. The fore grip of claim 1 that includes two second switches that are activated simultaneously to activate the light source when the first switch is in its third position.

11. The fore grip of claim 1 wherein the first switch is a slide switch.

12. The fore grip of claim 1 wherein the second switch is a momentary switch.

13. The fore grip of claim 10 wherein both second switches are momentary switches.

14. The fore grip of claim 1 that has an outer housing having a first half connected to a second half.

15. The fore grip of claim 1 wherein the first PCB and second PCB are physically separated.

16. The fore grip of claim 1 that has an attachment portion configured to attach to the picatinny rail of a firearm.

17. The fore grip of claim 1 wherein at least one lens in the lens slide modifies the laser light emitted from the laser module into a circular pattern of individual laser light beams.

* * * * *